US006142406A

United States Patent [19]

Newman

[11] Patent Number: 6,142,406

[45] Date of Patent: Nov. 7, 2000

[54] METHOD AND SYSTEM FOR CONTROLLING A COILED TUBING ARCH

[76] Inventor: Kenneth E. Newman, 9630 Rancho Dr., Willis, Tex. 77378

[21] Appl. No.: 09/300,786

[22] Filed: Apr. 27, 1999

[51] Int. Cl.[7] ..... B65H 75/34; E21B 23/00

[52] U.S. Cl. ..... 242/390.9; 166/77.2; 242/417; 242/418.1; 242/420.6

[58] Field of Search ..... 242/390.6, 390.9, 242/417, 417.3, 418.1, 420, 420.6, 421.6, 421.7, 413.4, 413.5, 413.6; 166/77.2; 175/103, 203; 254/134.3 R, 134.3 FT, 134.3 SC

[56] References Cited

U.S. PATENT DOCUMENTS

| | | | |
|---|---|---|---|
| 2,630,277 | 3/1953 | Haller | 242/420 |
| 2,757,880 | 8/1956 | De La Motte | 242/418.1 |
| 3,038,681 | 6/1962 | Herr | 242/417.3 |
| 3,289,959 | 12/1966 | Scher | 242/421.7 |
| 3,334,838 | 8/1967 | Kopp | 242/418.1 |
| 3,401,749 | 9/1968 | Daniel | 166/77.2 |
| 3,658,270 | 4/1972 | Slator et al. | 166/77.2 |
| 3,788,575 | 1/1974 | Boettcher et al. | 242/390.6 |
| 4,145,014 | 3/1979 | Chatard et al. | 242/390.9 |
| 4,437,619 | 3/1984 | Cary et al. | 242/413.5 |
| 5,344,089 | 9/1994 | Crowley et al. | 242/417 |
| 5,713,533 | 2/1998 | Nordlof et al. | 242/418.1 |
| 5,865,392 | 2/1999 | Blount et al. | 166/77.2 |

*Primary Examiner*—John M. Jillions
*Attorney, Agent, or Firm*—Guy McClung

[57] ABSTRACT

The present invention, in certain embodiments, discloses a method for controlling an arch portion of coiled tubing above an injector for injecting the coiled tubing into a bore, the method including monitoring at least height of the coiled tubing arch with monitor apparatus that produces a signal indicative of the height, sending said signal to arch maintenance apparatus, and maintaining height of the arch portion with the arch maintenance apparatus using said signal indicative of said height.

17 Claims, 5 Drawing Sheets

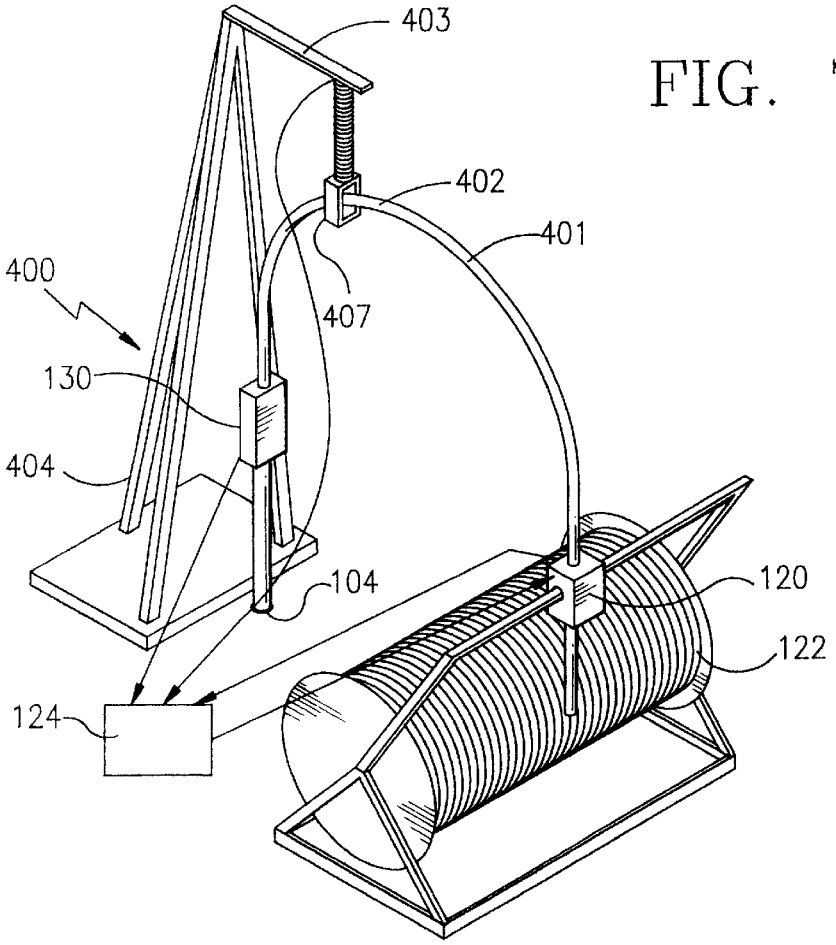
FIG. 7A
FIG. 7B
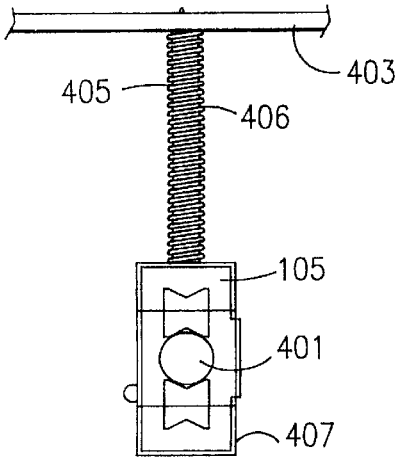

METHOD AND SYSTEM FOR CONTROLLING A COILED TUBING ARCH

BACKGROUND OF THE INVENTION

1. Field of the Invention

This invention relates to coiled tubing systems and, in certain particular aspects to arch control apparatus and methods for such systems.

2. Description of Related Art

Coiled tubing (CT) is pipe which can be run in and out of a well which may be a pipeline, tubular string, borehole, or wellbore. In certain embodiments, the CT is made of steel, titanium, plastic, or composites. The CT is stored on and spooled from a reel. In winding onto the reel, the CT is bent. Typically the CT is fed or spooled from the reel over a gooseneck or guide arch or an injector for directing the CT into a bore or well. When run into and out of a well, the CT is straightened as it comes off of the reel, bent as it goes around the guide arch, and straightened as it goes through the injector and into the well. When being pulled out of a well, the CT is bent around the guide arch, straightened as it goes towards the reel, then bent onto the reel. Thus in one trip in and out of a well, a given section of the CT is subjected to six bending and straightening events.

The CT, while it is on the reel, is like a coiled spring. Tension must be maintained on the CT as it leaves the reel at all times to control the CT on the reel and keep it from uncoiling. This tension used to control the CT on the reel is known as "reel back" tension.

Axial loads are applied to the CT both while it is being bent and straightened and while it is straight between the reel and guide arch (reel back tension) and while it is straight in a well. Repeated bending cycles can damage the coiled tubing. Internal pressure and axial loads can exacerbate this damage. The effects of this damage, known as fatigue damage, accumulate until the CT eventually fails. Failure is defined as the point at which the coiled tubing can no longer hold internal pressure, or, in extreme situations, the point at which the coiled tubing breaks. The fatigue life is the useful life of the CT before it fails due to accumulated fatigue damage.

One of the most important parameters affecting the fatigue life of the CT is the radius of bending. For a typical prior art system, e.g. as shown in FIG. 1, there are two radii of bending of coiled tubing CT. One is the radius of the reel R, and the second is the radius of the guide arch A. The reel R pulls continuously on the CT to provide the reel back tension needed to control the C on the reel. An injector I must overcome this reel back tension and control the CT as it runs in and out of the well. Of the six bending and straightening events described above, four happen at the guide arch A and two happen at the reel R. Thus, when considering ways of reducing fatigue damage, the radius of bending of the guide arch is more important than the radius of bending of the reel.

One prior art method of increasing the fatigue life (reducing the fatigue damage) involves allowing the CT to form a CT arch T as shown in FIG. 2. In this method, a small injector or reel tension device D on a reel L applies the tension to the CT needed to control the CT on the reel L. This system makes it possible the CT to form an arch between device D and an injector J. The arch T has a much larger radius of curvature than many typical guide arches. Thus this method increases the fatigue life, when compared to the system shown in FIG. 1.

A control system synchronizes the two devices, the device D with the injector J, to maintain the arch T at a constant size. If the arch T becomes too big, it may fall over. If the arch T becomes too small, it may bend or kink the coiled tubing CT or damage it in some other way. Prior art systems use depth/speed sensors to measure the CT movement at or near both the device D and the injector J. These measurements are used by a control system which synchronizes these two devices, causing them to move the same amount of CT through each device. One prior art system uses lateral load/position sensors S and N to sense the lateral load/position of the CT just above the injector J and device D. These lateral load/position measurements indicate lateral load/position of the CT as it exits the arch T. The control system(s) control the device D and the injector J to maintain the size of the arch T using these lateral load measurements; and, optionally, the depth/speed measurements at or near both the device D and the injector J are also used.

FIG. 3 shows another prior art system with the apparatus etc. of the system of FIG. 2 and with additional items. Wind forces or dynamic forces due to floating vessel movement can cause a coiled tubing arch to bend or buckle in some way. A control system error may allow the arch to become too large and lean or fall to one side. In one prior art system as shown in FIG. 3, two cables C are run from a support structure U on either side of a coiled tubing arch G. If something causes the arch G to lean or bend to one side or the other, it lays against the support cables C, preventing further bending.

U.S. Pat. No. 5,865,392 discloses a system for maintaining coiled tubing in layered coils on a reel. The system has a reel onto which the tubing is wound in layered coils and a layon roller made of compliant material maintained in physical contact with the tubing on the reel to prevent premature unwinding of the tubing during operation. The roller is moved towards and away from the tubing to maintain the roller in contact with the tubing as it is payed out and reeled onto the reel. The system has a level wind mechanism with apparatus for adjusting tension in the tubing as it passes through the level wind mechanism.

There have long been needs, recognized by the present inventor, for a system for measuring CT arch height and such a system which also uses this measurement in controlling such height.

SUMMARY OF THE PRESENT INVENTION

The present invention, in certain aspects, provides a method and system for injecting coiled tubing and for controlling a coiled tubing arch to maintain its radius of bending with a desired range to increase the useful life of the coiled tubing. According to certain aspects of such methods, height and one or more other CT parameters are measured, and using this or these measurements, arch height is controlled within a specified range to extend CT life. The arch may be measured at its apex or anywhere along the arch, preferably at a location which is not vertical. In one aspect the measurement(s) is/are made at a point or points along the arch which is closer to horizontal than to vertical. The location of this measurement may change as the arch changes height and shape.

The coiled tubing arch height (and, in certain aspects, CT length (depth) and/or speed of CT injection) is measured, according to the present invention, by methods which include contacting the coiled tubing and methods which do not involve actual physical contact. In one preferred embodiment, for measuring arch height a follower, roller mechanism or sliding sleeve which rides on the arch is positioned adjacent the arch. A support structure or cable may be used for such positioning. As the coiled tubing arch moves up or down, the roller mechanism correspondingly moves up or down on the support structure. One or more sensors on the support structure measure height of the roller mechanism and produces a signal indicative of this height and therefore of the height of the coiled tubing arch. This height signal is sent to a control system which uses this height measurement to control the reel tension device and/or the injector to maintain a desired height of the arch. This mechanism and support structure (and other supports disclosed herein) may also provide lateral support to the arch, preventing it from leaning or bending to one side. Prior art depth sensors and prior art injection speed sensors may be used to measure depth and speed, respectively.

In another embodiment the support structure has at least two sensors (e.g., but not limited to, magnetic sensors, eddy current proximity sensors, light sensors, infrared or ultrasonic sensors, and laser beam sensors) which sense the arch when it is in the proximity of the sensor. In one aspect two sensors are used indicating the upper and lower arch height, or a series of sensors is used to give a more continuous indication of the arch height. This height measurement is used to control the arch. Again, the support structure may be used to provide lateral support to the arch.

In another embodiment, a beam distance measuring sensor, like the known auto-focus sensor on a camera or known ultrasonic measuring devices, is mounted (or held manually) above or below the arch and is used to measure the distance from the sensor to a point on the arch. This distance, is then used to control the arch directly, or is used to calculate the height of the arch, which is then used to control the arch. In another aspect a rod, pole, beam, ruler or the like with a scale thereon or measurement indicators is positioned adjacent the arch for visual height determination. Such a rod, etc. may have one or more eyes or supports through which the CT moves for supporting the CT.

What follows are some of, but not all, the objects of this invention. In addition to the specific objects stated, other objects and purposes will be readily apparent to one of skill in this art who has the benefit of this invention's teachings and disclosures. It is, therefore, an object of at least certain preferred embodiments of the present invention to provide:

New, useful, unique, efficient, non-obvious systems and methods for injecting coiled tubing into a bore or well;

Such systems and methods which take into account height, and in certain aspects, one or more other CT parameters (e.g. speed of injection, length (depth) of injected coiled tubing) and provide selective desired control of a coiled tubing arch's height based on such parameter(s);

Such systems and method which also may provide lateral support for tubing during its use.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 7A is a schematic of a system according to the present invention.

FIG. 7B is an enlargement of a portion of the system of FIG. 7A.

DESCRIPTION OF EMBODIMENTS PREFERRED AT THE TIME OF FILING FOR THIS PATENT

Figure 1:
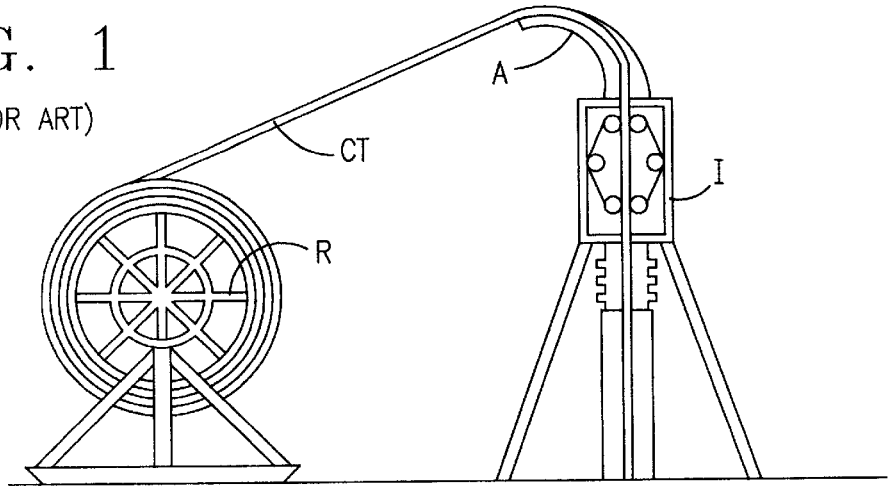
FIG. 1 (PRIOR ART)
FIGS. 1–3 are schematic views of prior art systems.
Figure 3:
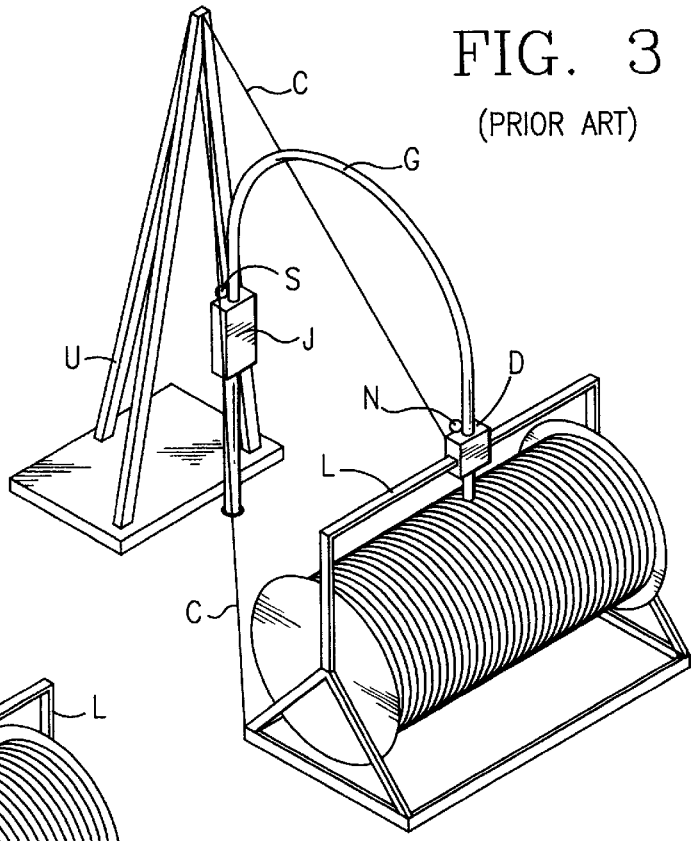
FIG. 3 (PRIOR ART)
Figure 2:
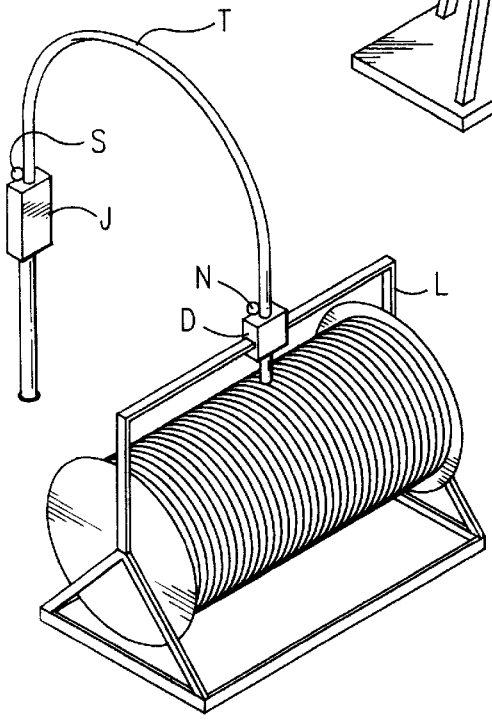
FIG. 2 (PRIOR ART)
Figure 4A:
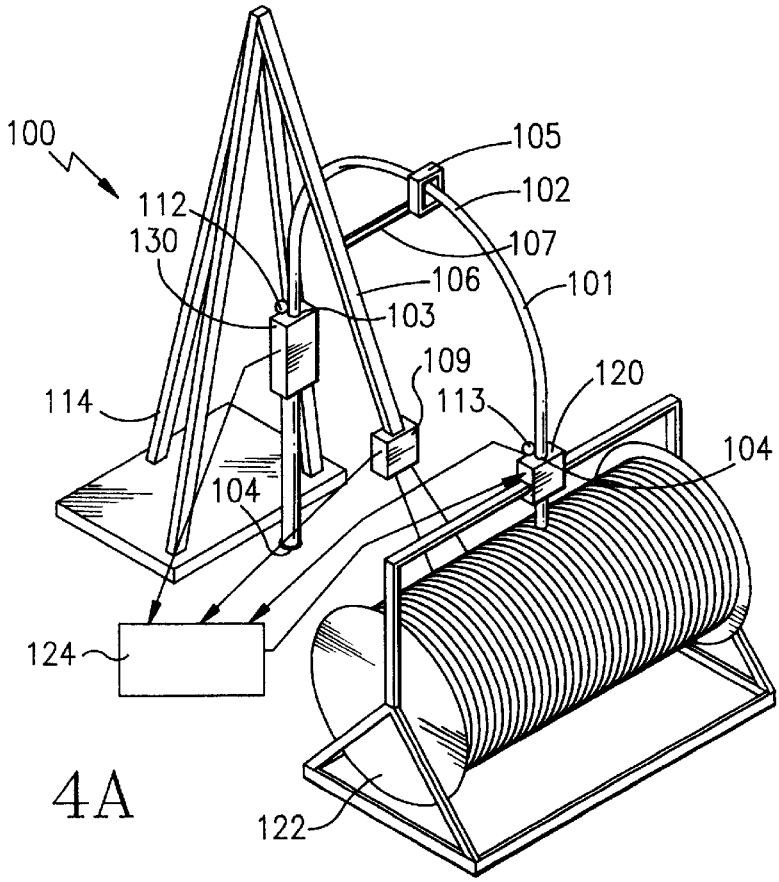
FIG. 4A is a schematic of a system according to the present invention.

FIG. 4A shows a control system 100 for controlling a coiled tubing arch 102 of coiled tubing 101 during injection of the coiled tubing into a bore or well 104. A reel tension device 120 used with a reel 122 is located at an end 104 of the arch 102 and an injector 130 is located at an end 103. A roller mechanism 105 is positioned adjacent to the arch 102 in such a way as to allow the coiled tubing 101 ("CT") to move freely up and down with and through the mechanism 105 which is (see FIG. 4B) also attached to a support structure 106 by a structural member 107 which slides freely up and down the support structure 106.

A series of micro-switches 108 are positioned along the support structure 106 to which a side support 114 is connected at the top. When the piece 148 of the structural member 107 touches a micro-switch 108, that switch is activated. Each micro-switch 108 is associated with a specific arch height measurement along the support structure 106. The signal from each micro-switch 108 is sensed by a micro-switch controller 109 that transmits a height signal associated with any micro-switch that is activated to an arch controller 124. The controller 124 may also receive depth/speed signals from depth/speed sensors 112, 113 at the injector 130 and the reel 122. The controller 124 uses these signals to control the devices 120 and/or injector 130 to maintain the height of the arch 102 within a certain range. Known LVDT linear transducers (or any other suitable electronic devices) connected to the member 107 may be used instead of or in addition to the micro-switches.

The arch controller 124 is in one aspect a process control device which receives analog or digital input signals, converts them to engineering units, performs control logic based upon the input signals and sends a control signal to the device 120. Control logic in arch controller 124 synchronizes the depth/speed signal of the device 120 with a depth/speed signal from the injector 130. If both are running at the same speed, the height of the CT arch 102 remains constant. However, if the height measurement drops below some pre-set lower limit, the arch controller 124 adjusts the speed of the reel tension device 120 slightly to cause the arch to increase in height. If the CT is being run into the well, the speed of the reel tension device 120 is increased to cause the height of the CT arch 102 to increase. If the CT is being pulled out of the well, the speed of the device 120 is decreased to increase the height of the CT arch 102. If the CT arch height becomes greater than some upper limit, the arch controller 124 adjusts the speed of the device 120 slightly to decrease arch height. If the CT is being run into the well, the speed of the device 120 is decreased to decrease the height of the CT arch 102. If the CT is being pulled out of the well, the speed of device 120 is increased to decrease the height of the CT arch 102.

In one aspect each micro-switch 108 feeds its signal into the arch controller 124, requiring many input channels on the arch controller 124. In one aspect the micro-switch controller 109 is a data acquisition/concentrator device that receives signals from all the micro-switches 108, and sends only one signal (corresponding to an identifying number of the particular micro-switch 108 which is currently on) to the arch controller 124. The arch controller 124 then correlates this number with an associated height in its logic.

Figure 4B:
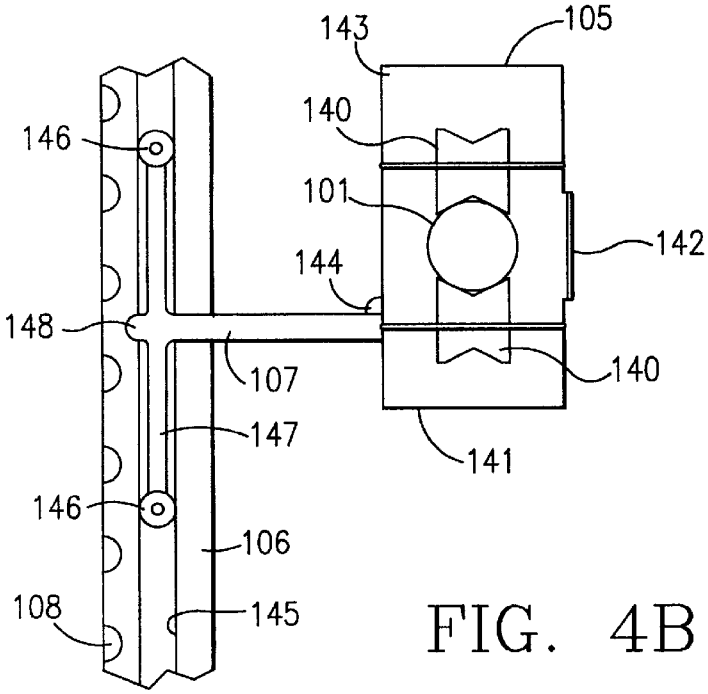
FIG. 4B is a side view in cross-section of part of the system of FIG. 4.
Figure 4C:
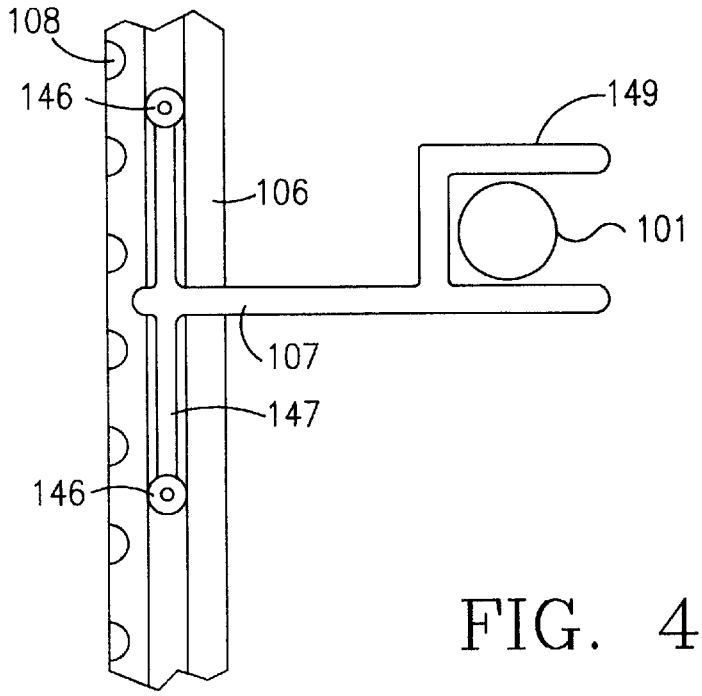
FIGS. 4C and 4D show alternative structures for a system according to the present invention.
Figure 4D:
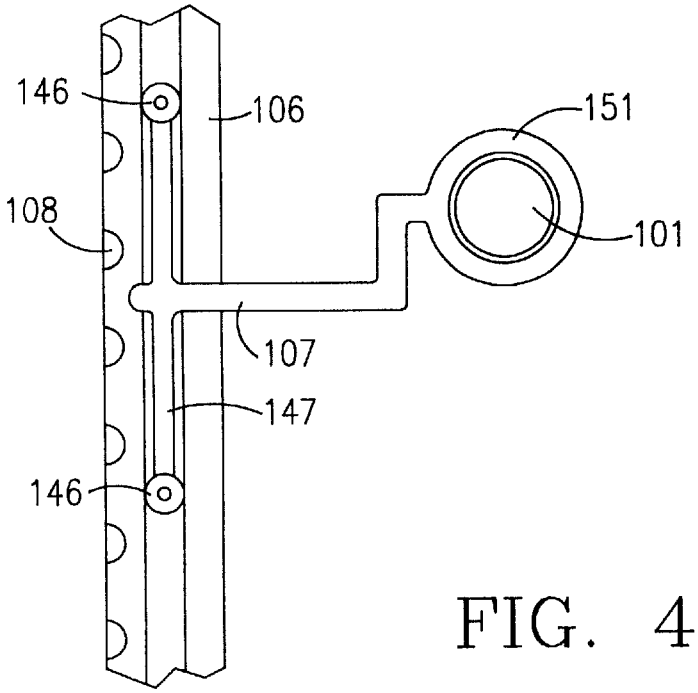

FIG. 4B shows the roller mechanism 105 with coiled tubing 101 running through it between rollers 140 rotatably mounted in a housing 141. A movable latch 142 permits insertion of the coiled tubing 101 into the housing 141 between the rollers 140. Also, a top portion 143 of the housing 141 (with a top roller 140) may, optionally, be hingedly attached with a hinge 144 to the structural member 107 to facilitate emplacement of the roller mechanism 105 about the coiled tubing 101. The support structure 106 has a track 145 in which are movable rollers 146 movably mounted to a cross member 147 which is formed integrally with or secured to the structural member 107. A piece 148 of the cross member 147 is sized and positioned to contact one of the micro-switches 108 for activation thereof. The roller mechanism helps maintain the lateral position of the coiled tubing arch. Alternatively, either roller 140 is eliminated and a non-rotatable immobile support member is used. In one aspect the roller or rollers 140 are non-rotatable bearing members between which the CT moves. FIG. 4C shows another embodiment in which the CT moves on a U-shaped member 149. Any suitable eye device, O-shaped support (completely encompassing the CT), or sleeve may be used instead of the U-shaped support 149. FIG. 4D shows support structure with an eye 151. Such roller mechanisms, U-shaped members, O-shaped members, eyes, and sleeves are referred to collectively as "follower" members.

Figure 5:
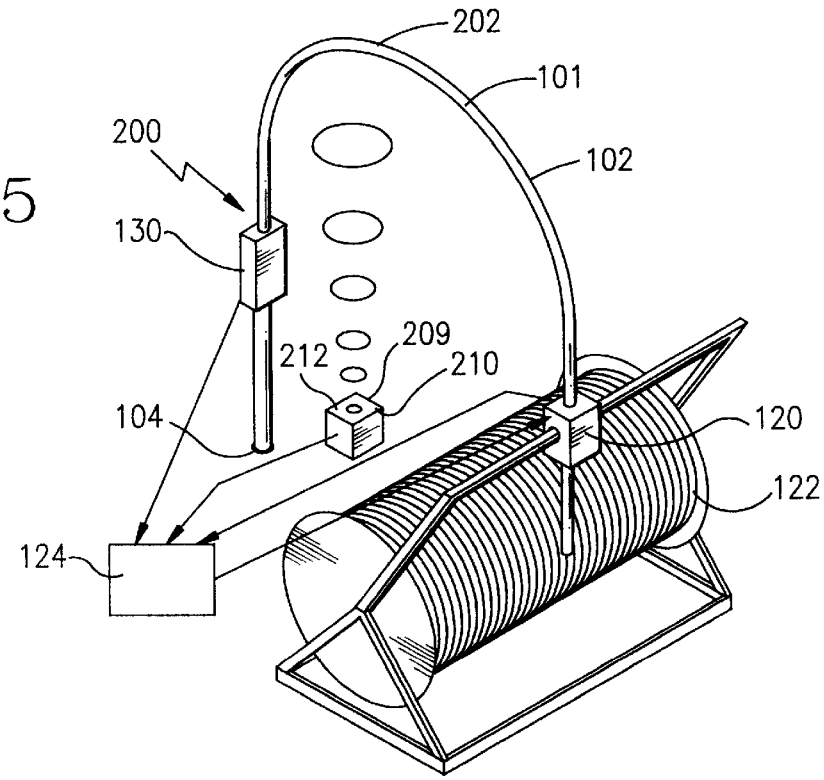
FIG. 5 is a schematic of a system according to the present invention.

The system 200 according to the present invention shown in FIG. 5 is like the system 100 of FIG. 4A (and like items have the same identifying numerals in FIGS. 4A and 5); but instead of a device 109 as in FIG. 4A, the system 200 has a measurement device 209 with a beam emitter 210 that emits a beam (e.g. infrared or ultrasound) received by a beam receiver 212 to measure the height of an arch portion 202. The device 209 intercommunicates with the controller 124. The arch controller 124 receives a height measurement signal from the measurement device 209.

Figure 6:
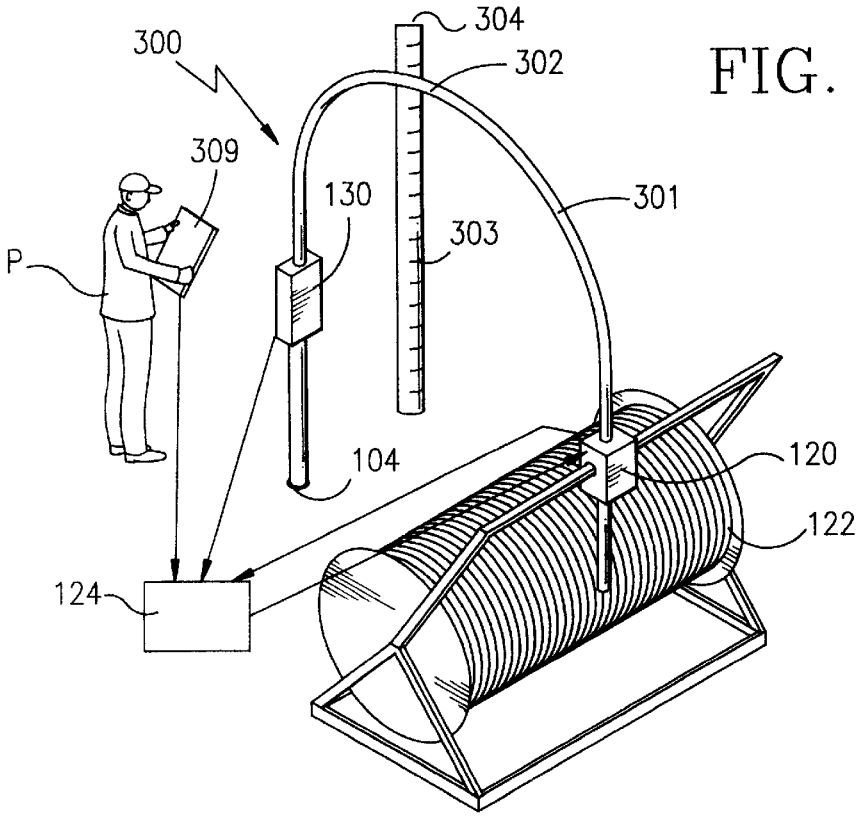
FIG. 6 is a schematic of a system according to the present invention.

FIG. 6 shows a system 300 according to the present invention with parts similar to those of the systems 100 and 200 (with like numerals identifying the same parts). The devices 109, 209 are eliminated. A rod 304 with a scale 303 thereon is positioned so that a person P can visually gauge the height of the arch portion 302 of the coiled tubing 301. The person P inputs the measured height into a device 309 (e.g. laptop computer, electronic console, keypad, etc.) which produces a signal indicative of the measurement and sends it to controller 124 (which uses it as described herein in controlling the arch).

Any device 109, 209, 309 and/or 124 may be near the associated coiled tubing system or remote therefrom. Any device 109, 209, 309 may be hard wired to the controller 124 or it may communicate wirelessly with the controller 124. Any device 109, 209 or 309 may be near or remote from a controller 124.

A system 400 according to the present invention shown in FIG. 7A is like the system 100 of FIG. 4A (and like items have the same identifying numerals in FIGS. 4A). A support arm 403 extends from a support 404 out over an arch 402 of coiled tubing 401. A linear transducer 405 within a spring 406 connected to the arm 403 indicates the distance of a housing 407 below the support arm 403. This distance corresponds to the height of the arch 402. A signal indicative of this distance, and, therefore, of the height of the arch, is sent from the linear transducer to the arch controller 124. The arch controller maintains arch height using this signal as described above. As shown in FIG. 7B, a roller mechanism as in the mechanism 105 described above may be used with the system 400. The depth and speed sensors of the system 100 may also be used.

The present invention, therefore, provides in certain, but not necessarily all embodiments, a method for controlling an arch portion of coiled tubing above an injector for injecting the coiled tubing into a bore, the method including monitoring height of the arch portion of the coiled tubing with monitor apparatus that produces a signal indicative of said height, sending said signal to arch maintenance apparatus, and maintaining position of the arch portion with the arch maintenance apparatus using said signal indicative of said height. Such a method may also include one, some (in any possible combination) or all of the following: wherein the monitor apparatus includes a supported roller mechanism movable by the arch portion and positioned about the arch portion, the roller mechanism on a structural member that itself moves with respect to a support member having a plurality of actuatable electronic devices spaced-apart, a portion of the structural member activating a particular one of the plurality of actuatable electronic devices adjacent thereto, a signal sendable from said particular actuatable electronic device indicative of height of said device which is corresponds to a height of the arch portion, said method including controlling height of the arch portion with said arch maintenance apparatus based on the signal from the particular actuatable electronic device; wherein the actuatable electronic devices of the plurality of actuatable electronic devices are a plurality of spaced-apart micro-switches and/or linear transducers; wherein the particular actuatable electronic device sends the signal indicative of roller mechanism position to a data acquisition device able to in turn relay the signal to the arch controller device, the data acquisition device in communication with all the actuatable electronic devices of the plurality thereof, the method further including sending the signal indicative of roller mechanism position to the data acquisition device, and relaying a relay signal from the data acquisition device to the arch controller device, the relay signal indicative of roller mechanism position; wherein the monitor apparatus includes a beam emitter that sends an incident beam to the arch portion and a beam receiver that receives a corresponding reflected beam reflected from the arch portion, the monitor apparatus then using said reflected beam in producing a signal indicative of height of the arch portion, the method further including sending the incident beam with the beam emitter to the arch portion, receiving the reflected beam from the arch portion with the beam receiver, producing with the monitor apparatus a resultant signal indicative of height of the arch portion, and sending said resultant signal to the arch maintenance apparatus for use thereby to maintain position of said arch portion; wherein the beam emitter emits an ultrasonic or an infrared beam receivable by the beam receiver; wherein the arch maintenance apparatus includes a control system for controlling the injector, the method including controlling the injector with the arch maintenance apparatus to control arch portion position; wherein the control system includes apparatus for controlling injection speed of the coiled tubing into the bore, the method including controlling with the arch maintenance apparatus speed of injection of coiled tubing into the bore; wherein the arch maintenance apparatus includes a reel tension device adjacent the coiled tubing for controlling reel tension, the method including controlling the reel tension device with the arch maintenance apparatus to control arch position; wherein the bore is a wellbore in the earth, the method including injecting the coiled tubing into the wellbore; wherein a supported portion of the monitor apparatus provides lateral support for the arch portion of the coiled tubing, the method further including maintaining lateral position of the arch portion with the supported portion of the monitor apparatus; wherein the monitor apparatus includes a ruler device with a plurality of spaced-apart indicators thereon visually monitorable by a person having a signal production device for producing a height signal based on input by the person indicative of height of the arch portion, the method including visual monitoring of the ruler device by the person to ascertain arch portion height, production of the height signal by the person using the signal production device, and sending the height signal to the arch maintenance apparatus for control of the arch portion; and/or wherein the monitor apparatus includes a follower member positioned adjacent and movable by the arch portion, the follower member on a structural member that itself moves with respect to a support member having a plurality of spaced-apart actuatable electronic devices, a portion of the structural member activating a particular actuatable electronic device of the plurality thereof adjacent thereto, a signal sendable from said particular actuatable device indicative of follower position to the arch maintenance apparatus, said follower position corresponding to a height of the arch portion, said method including controlling height of the arch portion with said arch maintenance apparatus based on the signal from the particular actuatable electronic device.

The present invention, therefore, provides in certain, but not necessarily all embodiments, a method for controlling an arch portion of coiled tubing above an injector for injecting the coiled tubing into a bore, the method including monitoring height of the arch portion of the coiled tubing with monitor apparatus that produces a signal indicative said height, sending said signal to arch maintenance apparatus, maintaining position of the arch portion with the arch maintenance apparatus using said signal indicative of said height, maintaining height of the arch portion within a desired height range with the arch maintenance apparatus, wherein the arch maintenance apparatus includes apparatus for controlling injection speed of the coiled tubing into the bore, controlling with the arch maintenance apparatus speed of injection of coiled tubing into the bore, wherein the arch maintenance apparatus includes a reel tension control device adjacent the coiled tubing, and controlling the reel tension control device with the arch maintenance apparatus to control arch position.

The present invention, therefore, provides in certain, but not necessarily all embodiments, an arch control system for controlling an arch portion of coiled tubing above an injector for injecting coiled tubing into a bore, the arch control system including monitor apparatus for monitoring height of the arch portion of the coiled tubing, the monitor apparatus including a visually observable ruler device and an electronic device used by the observer to input observed arch height and send a height signal or the monitor apparatus for itself producing a signal indicative of said height and transmitting said signal to arch maintenance apparatus, and arch maintenance apparatus for maintaining position of said arch portion using said signal from said monitor apparatus; such a system with a follower member positioned adjacent and movable by the arch portion, the follower member on a structural member that itself moves with respect to a support member having a plurality of spaced-apart actuatable electronic devices, a portion of the structural member activating a particular actuatable electronic device of the plurality thereof adjacent thereto, a signal sendable from said particular actuatable electronic device indicative of follower position to the arch maintenance apparatus, said follower position corresponding to a height of the arch portion; and/or such a system with a control system for controlling the injector, a reel tension control device adjacent the coiled tubing for controlling reel tension, and the arch maintenance apparatus intercommunicating with the control system of the injector and with the reel tension control device to control them thereby controlling arch height; and/or such a system with lateral position maintenance apparatus for maintaining lateral position of the arch portion.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims are in accordance with all of the requirements of 35 U.S.C. § 112. The inventors may rely on the Doctrine of Equivalents to determine the scope of their invention and the claims that follow as they may pertain to apparatus not materially departing from, but outside of, the literal scope of the invention as set forth in the claims.

What is claimed is:

1. A method for controlling an arch portion of coiled tubing above an injector for injecting the coiled tubing into a bore, the method comprising monitoring height of the arch portion of the coiled tubing with monitor apparatus that produces a signal indicative of said height, sending said signal to arch maintenance apparatus, maintaining position of the arch portion with the arch maintenance apparatus using said signal indicative of said height, wherein the monitor apparatus includes a supported roller mechanism movable by the arch portion and positioned about the arch portion, the roller mechanism on a structural member that itself moves with respect to a support member having a plurality of actuatable electronic devices spaced-apart, a portion of the structural member activating a particular one of the plurality of actuatable electronic devices adjacent thereto, a signal sendable from said particular actuatable electronic device indicative of height of said device which is corresponds to a height of the arch portion, said method further comprising controlling height of the arch portion with said arch maintenance apparatus based on the signal from the particular actuatable electronic device.

2. The method of claim 1 wherein the actuatable electronic devices of the plurality of actuatable electronic devices are a plurality of spaced-apart micro-switches.

3. The method of claim 2 wherein the particular actuatable electronic device sends the signal indicative of roller mechanism position to a data acquisition device able to in turn relay the signal to the arch maintenance apparatus, the data acquisition device in communication with all the actuatable electronic devices of the plurality thereof, the method further comprising sending the signal indicative of roller mechanism position to the data acquisition device, and relaying a relay signal from the data acquisition device to the arch maintenance apparatus, the relay signal indicative of roller mechanism position.

4. The method of claim 1 wherein the monitor apparatus includes a beam emitter that sends an incident beam to the arch portion and a beam receiver that receives a corresponding reflected beam reflected from the arch portion, the monitor apparatus then using said reflected beam in producing a signal indicative of height of the arch portion, the method further comprising sending the incident beam with the beam emitter to the arch portion, receiving the reflected beam from the arch portion with the beam receiver, producing with the monitor apparatus a resultant signal indicative of height of the arch portion, and sending said resultant signal to the arch maintenance apparatus for use thereby to maintain position of said arch portion.

5. The method of claim 4 wherein the beam emitter emits an ultrasonic beam receivable by the beam receiver.

6. The method of claim 4 wherein the beam emitter emits an infrared beam receivable by the beam receiver.

7. The method of claim 1 wherein the arch maintenance apparatus includes a reel tension device adjacent the coiled tubing for controlling reel tension, the method further comprising controlling the reel tension device with the arch maintenance apparatus to control arch position.

8. The method of claim 1 wherein the bore is a wellbore in the earth, the method further comprising injecting the coiled tubing into the wellbore.

9. The method of claim 1 wherein a supported portion of the monitor apparatus provides lateral support for the arch portion of the coiled tubing, the method further comprising maintaining lateral position of the arch portion with the supported portion of the monitor apparatus.

10. A method for controlling an arch portion of coiled tubing above an injector for injecting the coiled tubing into a bore, the method comprising monitoring height of the arch portion of the coiled tubing with monitor apparatus that produces a signal indicative of said height, sending said signal to arch maintenance apparatus, maintaining position of the arch portion with the arch maintenance apparatus using said signal indicative of said height, wherein the arch maintenance apparatus includes a control system for controlling the injector, the method further comprising controlling the injector with the arch maintenance apparatus to control arch portion position.

11. The method of claim 10 wherein the control system includes apparatus for controlling injection speed of the coiled tubing into the bore, the method further comprising controlling with the arch maintenance apparatus speed of injection of coiled tubing into the bore.

12. The method of claim 10 wherein the monitor apparatus includes a ruler device with a plurality of spaced-apart indicators thereon visually monitorable by a person having a signal production device for producing a height signal based on input by the person indicative of height of the arch portion, the method further comprising visual monitoring of the ruler device by the person to ascertain arch portion height, production of the height signal by the person using the signal production device, and sending the height signal to the arch maintenance apparatus for control of the arch portion.

13. A method for controlling an arch portion of coiled tubing above an injector for injecting the coiled tubing into a bore, the method comprising monitoring height of the arch portion of the coiled tubing with monitor apparatus that produces a signal indicative of said height, sending said signal to arch maintenance apparatus, and maintaining position of the arch portion with the arch maintenance apparatus using said signal indicative of said height, wherein the monitor apparatus includes a follower member positioned adjacent and movable by the arch portion, the follower member on a structural member that itself moves with respect to a support member having a plurality of spaced-apart actuatable electronic devices, a portion of the structural member activating a particular actuatable electronic device of the plurality thereof adjacent thereto, a signal sendable from said particular actuatable device indicative of follower position to the arch maintenance apparatus, said follower position corresponding to a height of the arch portion, said method further comprising controlling height of the arch portion with said arch maintenance apparatus based on the signal from the particular actuatable electronic device.

14. The method of claim 13 wherein the actuatable electronic devices of the plurality of actuatable electronic devices are a plurality of spaced-apart linear transducer devices.

15. An arch control system for controlling an arch portion of coiled tubing above an injector for injecting coiled tubing into a bore, the arch control system comprising monitor apparatus for monitoring height of the arch portion of the coiled tubing to produce a signal indicative of said height and transmitting said signal to arch maintenance apparatus, arch maintenance apparatus for maintaining position of said arch portion using said signal from said monitor apparatus, and a follower member positioned adjacent and movable by the arch portion, the follower member on a structural member that itself moves with respect to a support member having a plurality of spaced-apart actuatable electronic devices, a portion of the structural member activating a particular actuatable electronic device of the plurality thereof adjacent thereto, a signal sendable from said particular actuatable electronic device indicative of follower position to the arch maintenance apparatus, said follower position corresponding to a height of the arch portion.

16. The arch control system of claim 15 further comprising a control system for controlling the injector, a reel tension control device adjacent the coiled tubing for controlling reel tension, and the arch maintenance apparatus intercommunicating with the control system of the injector and with the reel tension control device to control them thereby controlling arch height.

17. The arch control system of claim 16 further comprising lateral position maintenance apparatus for maintaining lateral position of the arch portion.

* * * * *